United States Patent [19]

Hirai

[11] Patent Number: 4,704,540

[45] Date of Patent: Nov. 3, 1987

[54] PHOTOELECTRIC SHOCK WAVE DETECTION SYSTEM FOR VACUUM PROTECTION

[75] Inventor: Yasuharu Hirai, Chofu, Japan

[73] Assignee: Hitachi, Ltd., Tokyo, Japan

[21] Appl. No.: 871,997

[22] Filed: Jun. 9, 1986

[30] Foreign Application Priority Data

Jun. 17, 1985 [JP] Japan ..... 60-129781

[51] Int. Cl.[4] ..... G08B 21/00

[52] U.S. Cl. ..... 250/573; 340/540

[58] Field of Search ..... 250/573; 356/436, 437, 356/438, 439; 340/679, 603, 626, 540

[56] References Cited

U.S. PATENT DOCUMENTS

| | | | |
|---|---|---|---|
| 3,731,743 | 5/1973 | Marshall | 356/436 |
| 3,885,162 | 5/1975 | Geertz | 356/43 |
| 4,297,687 | 10/1981 | Fuzzell | 340/626 |
| 4,544,273 | 10/1985 | Berndt | 356/439 |
| 4,553,139 | 11/1985 | Tanigaki et al. | 340/626 |

*Primary Examiner*—David C. Nelms

*Assistant Examiner*—William L. Oen

*Attorney, Agent, or Firm*—Antonelli, Terry & Wands

[57] ABSTRACT

A shock wave detection system used in a vacuum protection system constructed so that a high-speed shutter provided in a vacuum pipe connecting a vacuum system with an experimental apparatus is closed in response to the detection of an atmospheric shock wave that will rush into the vacuum system when an accidental vacuum breakdown occurs at the experimental apparatus. This shock wave detection system comprises an incident light window and an outgoing light window that are provided on the side of the vacuum pipe at the positions opposite to each other, an optical system for entering the light flux linearly polarized or not polarized the incident light window, another optical system for focusing the light flux outgoing from said outgoing light window, an optical fiber for receiving on its surface a diffraction image produced due to the change of light refractivity when the wave front of the shock wave crosses said light flux in the vacuum pipe, and a photo-detector for transforming the diffraction image into a signal for driving the high-speed shutter.

10 Claims, 1 Drawing Figure

PHOTOELECTRIC SHOCK WAVE DETECTION SYSTEM FOR VACUUM PROTECTION

BACKGROUND OF THE INVENTION

This invention relates to a shock wave detection system and more particularly to a shock wave detection system which is used in a vacuum protection system.

This vacuum protection system is generally constructed so that a fast closing shutter provided in a vacuum pipe connecting a vacuum system with an experimental apparatus is closed in response to the detection of an atmospheric shock wave that will rush into the vacuum system when an accidental vacuum breakdown occurs at the experimental apparatus. In carrying out some researches using synchrotoron orbital radiation (SOR), for example, the SOR are derived from electron storage rirgs maintained at a high vacuum more than $10^{-7}$ Torr through beam lines and the experimental apparatuses are connected with the ends of these beam lines, respectively. In this case, the high-speed shutter and a delay line are provided for each beam line so that the high vacuum system of the electron storage ring is not influenced by the accident such as the vacuum breakdown that may occur at the experimental apparatus side. In such an arrangement, it has been eagerly desired to establish such a system as providing the response time of the valve higher than the atmospheric leakage rate when the vacuum breakdown occurs at the experimental apparatus side.

To this end, there has been proposed a fast closing shutter such as disclosed in the article entitled "High-speed shutter for ultra high vacuum system" by S. Sata et al in the report collection, page 59 delivered in the 1983 conference of the Institute of Electrical Engineers of Japan. However, since in this proposed device, an ion pump with a pumping speed of 1 l/sec. is used as the shock wave detecting device and so the ion current is on the order of $\mu$A, the shock wave detecting device has problems such that it is likely to malfunction due to noises derived from the power source for driving the electron storage ring and when the pressure in the beam line is increased, the ion pump may be subjected to overload resulting in turning off the power source thereby to stop the pumping action and that the response speed of the ion pump is generally low in the order of several m sec. For practical use, no sufficient measures have been taken against these problems.

SUMMARY OF THE INVENTION

In view of the foregoing, it is an object of this invention to provide a shock wave detection system with high immunity from noises, a stabilized operation and a high response speed.

In order to attain this object, in accordance with this invention, a shock wave detection system which is provided in a path communicating a vacuum system with a location where a shock wave possibly occurs for preventing the shock wave generated in the location from propagating into the vacuum system, is arranged to comprise means provided on the path between the location and the vacuum system for detecting a shock wave generated in the location and propagating through the path towards the vacuum system and means provided in the path between the detecting means and the vacuum system to activate, in response to detection of the shock wave by the detecting means, to prevent the shock wave from propagating into the vacuum system, wherein the detecting means is arranged to detect the change of light refractivity when the shock wave passes therethrough.

Meanwhile, in the case where the shock wave rushes through the path maintained at ultra high vacuum from the one end thereof, the shock wave abruptly varies in its pressure distribution from ultra-high vacuum at its wave front an atmospheric part thereof. With a light being incident perpendicularly to the path of the wave front, the refractivity greatly changes when the wave front passes, thus producing a diffraction image. The method for observing the change in density of a transparent object using this phenomenon is called "Schlieren method". This invention intends to apply the principle of the Schlieren method to the shock wave detection.

The above and other objects, features and advantages of this invention will be more apparent from the following description taken in conjunction of the drawing.

DESCRIPTION OF THE PREFERRED EMBODIMENT

Figure 1:
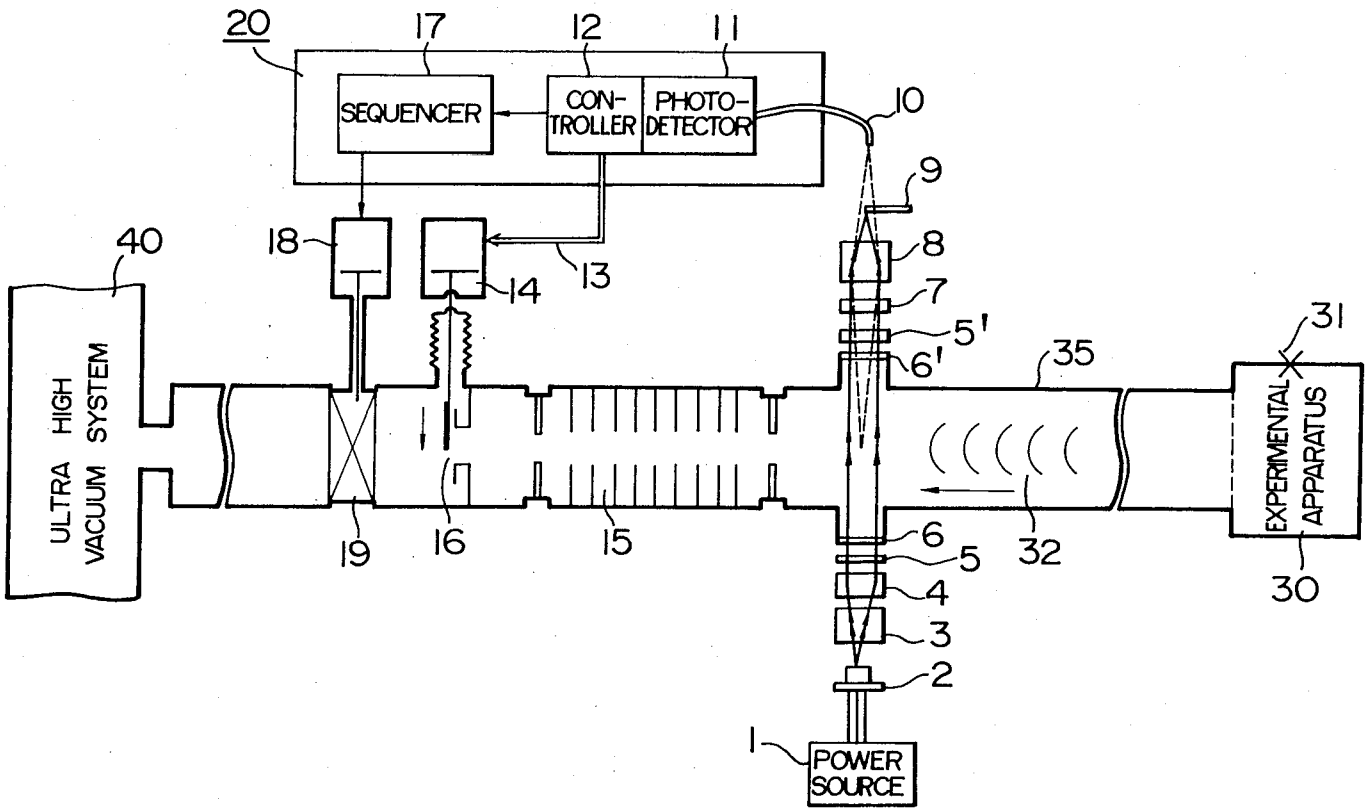
FIG. 1 shows an entire arrangement of a vacuum protection system equipped with a shock wave detection system according to one embodiment of this invention.

Referring now to FIG. 1, it is assumed that atmospheric leakage due to the accidental vacuum breakdown at a point X indicated with 31 in an experimental apparatus occurs in a vacuum pipe or path, e.g. beam line 35 connecting the experimental apparatus 30 and an ultra-high vacuum system, e.g. electron storage ring 40 and a shock wave produced in the vacuum path at this time is detected. An incident light window 6 and an outgoing light window 6' are provided on the side of the vacuum path 35 at the positions opposite to each other so that they can withstand ultra-high vacuum. In FIG. 1, 1 denotes a power source for laser light oscillation, 2 denotes a laser diode for oscillating a linealy polarized laser light with wavelengths ranging from far-infrared to infrared regions, 3 denotes a beam expander, 4 denotes a collimating lens for changing the laser light outgoing from beam expander 3 into a parallel light beam, and 5 denotes a polarizer. These elements 1 to 5 construct an optical system at the incident light window side. When the SOR light in the electron storage ring is linearly polarized in a horizontal plane, for example, polarizer 5 linearly polarizes the laser light oscillated by laser diode 2 in a vertical plane and the polarized laser light is incident on incident light window 6 with the polarization direction of polarizer 5 being coincident with that of this laser light.

Furthermore, in FIG. 1, 5' is a polarizer provided at the light outgoing side so that its polarization direction coincides with that of polarizer 5, 7 is a bandpass filter for passing only the oscillation wavelength of the laser light, 8 is a focusing lens for imaging, 9 is an edge for cutting the component of the laser light not influenced by the shock wave, 10 is an optical fiber for receiving, at its surface, a diffraction image produced by the refractivity change when the wave front of shock wave 32 crosses the laser light in vacuum path 35, and 11 is a photo-detector for transforming the diffraction image into electric signals. These elements 1 to 11 construct a shock wave detection system in accordance with one embodiment of this invention.

Further, in FIG. 1, 12 is a high-speed shutter controller, 13 is a signal transmission table, 14 is a shutter driving cylinder, 15 is a shock wave delay line, 16 is a high-speed shutter, 17 is a valve control sequencer, 18 is a valve driving cylinder, 19 is a pneumatic valve and 20 is a rack for housing elements, 11, 12 and 17. The structure composed of elements 12 to 20 serves to intercept ultra high vacuum system 40 from experimental apparatus 30.

The arrangement mentioned above operates as follows.

A linearly polarized laser light with a wavelength of e.g. 1.3 μm is produced from the laser diode 2. As mentioned above, the laser light is linearly polarized in a vertical plane when the SOR light in vacuum polarizer 35 is linearly polarized in a horizontal plane. In this way, it is possible to greatly reduce noise production when the shock wave is detected. The laser light is expanded by beam expander 3 and collimated by collimator lens 4. The collimated laser light is projected through the polarizer 5, of which the direction of linear polarization is the same as that of the incident laser light, into the light incident window 6 and then outputted from the light outgoing window 6'. The outputted laser light is passed through the polarizer 5' and the bandpass filter 7 so as to allow only a component of the laser light which is linearly polarized in the same plane of polarization as that of the incident light to be focussed by the focussing lens 8 onto a plane where the edge 9 is disposed for blocking the incident light so as not to reach the optical fiber 10, so long as no accident occurs in the vacuum path 35. However, if an accident, such as vacuum breakdown, occurs in the experimental apparatus 30 and the wave front of a shock wave propagates the laser light passing through the vacuum path, the refractivity of the vacuum path changes so that a diffraction image is focussed on an end of the optical fiber 10. In this case, the image focussed on the edge is not affected by the change of refractivity and hence blocked by edge 9. Thus, the brightness of light projected onto the end of the optical fiber 10 is greatly changed depending on whether an accident which changes the refractivity of the vacuum path occurs or not.

The light detector 11, such as a photodiode, is provided to detect the brightness of the end of the optical fiber 10 thereby producing an electric signal corresponding to the brightness, which is applied through the high-speed shutter controller 12 and the signal transmission cable 13 to the shutter driving cylinder 14 for closing the high-speed shutter 16. Shutter driving cylinder 14 may be either a plunger structure actuated by electromagnetic force or a cylinder structure actuated air or oil pressure. The shutter driving cylinder 14 is actuated by the electric signal sent through signal transmission cable 13 and the plunger or piston in the cylinder is pressed down to close the high-speed shutter 16. On the other hand, the travelling speed of the wave front of shock wave 32 can be delayed by several tens to several hundreds milli sec. by shock wave delay line 15. Therefore, if the high-speed shutter 16, which generally actuates in several milli sec., is closed during this period, it is possible to prevent the ultra-high vacuum system 40 side from being influenced by the vacuum breakdown occurred at the experimental apparatus 30 side. In this embodiment, the shock wave is detected in such a way that its pressure change is represented by the refractivity change, so that the response speed of detection is determined by photo-detector 11. When photo-detector 11 is constructed by a photodiode, this response speed is several tens n sec. or less, which permits ultra-high vacuum system 40 to be sufficiently protected.

Valve control sequencer 17, valve driving cylinder 18 and pneumatic valve 19 are provided for further completing the vacuum sealing, and the pneumatic valve 19, which is adapted to give ultra high vacuum, is closed by the closing signal sent there.

The shock wave detection system according to this embodiment permitted the pressure change of $10^{-4}$ Torr to be detected using a laser light of 100 mW.

Incidentally, the above explanation as to this embodiment has been given for the case where the laser light subject to linear polarization is used. This invention, however, can also be realized using a laser light not subject to linear polarization, or a natural light, and provides the same operation and effect as the above case.

In accordance with this invention, there have been provided the following advantages.

(1) The prior art system provides the response speed of detection as large as several m sec., whereas this invention provides the response speed of detection as small as several tens n sec. or less since the photodetector detects the pressure change of the shock wave as the refractivity change, thus permitting the closing signal to be sent to the high-speed shutter at high speed.

(2) The shock wave detection system according to this invention is entirely constructed by an optical system so that it is not influenced by electromagnetic noises. More specifically, the prior art system is greatly influenced by the electromagnetic noises produced from the electron storage ring that is constructed by magnets or the like operable with large currents and so is likely to malfunction, whereas this invention is not susceptible to the electromagnetic noises since it is constructed by an optical system, and so is not very likely to malfunction.

(3) This invention can be easily dealt with as compared with the prior art system. This is because in this invention the entire optical system used is arranged outside the vacuum pipe, eliminating the necessity of breaking the vacuum in the vacuum pipe, whereas in the prior art system the detector is incorporated in the vacuum pipe.

I claim:

1. A shock wave detection system provided in a path communicating a vacuum system with a location where a shock wave possibly occurs for preventing the shock wave generated in the location from propagating into the vacuum system; said system comprising means provided on the path for detecting a shock wave generated in the location and propagating through the path towards the vacuum system and means provided in the path between the detecting means and the vacuum system to actuate, in response to detection of the shock wave by the detecting means, to prevent the shock wave from propagating into the vacuum system, wherein said detecting means is adapted to detect change of light refractivity occurring said shock wave passes said path.

2. A shock wave detection system according to claim 1, wherein said shock wave is an experimental apparatus and said vacuum is an electron storage ring.

3. A shock wave detection system according to claim 2, wherein a shock wave delay line is provided in said path.

4. A shock wave detection system according to claim 1, further comprising a valve for vacuum sealing provided in the path, said valve being closed in response to the detection of said shock wave.

5. A shock wave detection system according to claim 1, wherein a shock wave delay line is provided in said path.

6. A shock wave detection system according to claim 5, further comprising a valve for vacuum sealing provided in the path, said valve being closed in response to the detection of said shock wave.

7. A shock wave detection system comprising a shock wave source, a vacuum system receiving said vacuum system, a path of said shock wave, means for detecting the shock wave and a shutter adapted to prevent said shock wave detected from rushing into said vacuum system, wherein said detecting means comprises a light source, means for passing the light flux outgoing from the light source through said path, and means for detecting change of light refractivity occurring when said shock wave crosses said light flux in the path.

8. A shock wave detection system according to claim 7, wherein said shock wave source is an experimental apparatus and said vacuum system is an electron storage ring.

9. A shock wave detection system according to claim 8, further comprising a shock wave delay line provided in said path.

10. A shock wave detection system according to claim 9, further comprising a valve for vacuum sealing provided in the path, said valve being closed in response to the detection of said shock wave.

* * * * *